US005302249A

United States Patent [19]

Malhotra et al.

[11] Patent Number: 5,302,249

[45] Date of Patent: Apr. 12, 1994

[54] TREATED PAPERS

[75] Inventors: Shadi L. Malhotra, Mississauga; David F. Rutland, Milton; Arthur Y. Jones, Mississauga, all of Canada

[73] Assignee: Xerox Corporation, Stamford, Conn.

[21] Appl. No.: 469,985

[22] Filed: Jan. 25, 1990

[51] Int. Cl.[5] ..... D21H 25/00

[52] U.S. Cl. ..... 162/135; 162/164.4; 162/177; 427/391

[58] Field of Search ..... 162/164.4, 135, 177, 162/134; 106/195, 196, 197.1, 197.2, 287.13; 427/391

[56] References Cited

U.S. PATENT DOCUMENTS

| | | | |
|---|---|---|---|
| 3,520,774 | 7/1970 | Roth et al. | 162/164 |
| 3,592,730 | 7/1971 | Newmann | 162/184 |
| 3,755,071 | 8/1973 | Bey et al. | 162/164.4 |
| 4,049,860 | 9/1977 | Armbrust et al. | 428/201 |
| 4,198,269 | 4/1980 | Evani et al. | 162/164 EP |
| 4,279,794 | 7/1981 | Dumas | 260/29.2 EP |
| 4,478,682 | 10/1984 | Bankert et al. | 162/158 |
| 4,510,227 | 4/1985 | Mohr et al. | 430/175 |

FOREIGN PATENT DOCUMENTS

| | | | |
|---|---|---|---|
| 372308 | 7/1973 | U.S.S.R. | 106/197.2 |
| 922828 | 4/1963 | United Kingdom | 427/391 |

*Primary Examiner*—W. Gary Jones
*Assistant Examiner*—Brenda Lamb
*Attorney, Agent, or Firm*—E. O. Palazzo; Z. Soong

[57] ABSTRACT

A paper comprised of a supporting substrate with a coating comprised of a desizing component and a hydrophilic polymer, and more specifically in an embodiment the paper is comprised of a paper comprised of a supporting substrate treated with desizing agents selected from the group consisting of (1) hydrophilic poly(dialkylsiloxanes); (2) poly(alkylene glycol); (3) poly(propylene oxide)-poly(ethylene oxide) copolymers; (4) fatty ester modified compounds of phosphate, sorbitan, glycerol, poly(ethylene glycol), sulfosuccinic acid, sulfonic acid and alkyl amine; (5) poly(oxyalkylene) modified compounds of sorbitan esters, fatty amines, alkanol amides, castor oil, fatty acids and fatty alcohols; (6) quaternary alkosulfate compounds; (7) fatty imidazolines; and mixtures thereof.

15 Claims, No Drawings

TREATED PAPERS

BACKGROUND OF THE INVENTION

This invention relates generally to papers which, for example, are suitable for various printing processes, and more specifically the present invention is directed to size press treated plain papers and the use of these papers in ink jet printing processes, dot matrix and impact printers, gravure printing systems, xerographic imaging and thermal transfer printing processes. In one embodiment, the present invention relates to papers comprised of a supporting substrate surface treated preferably on a size press, a known apparatus used to coat or treat the paper during the drying process in a paper machine or a coating apparatus, such as a Dilts Coater, with a mixture of starch or other similar component, such as gelatin, with certain desizing agents including hydrophilic poly(dimethyl siloxanes); poly(alkylene glycol), the derivatives thereof, poly(propylene oxide)-poly(ethylene oxide) copolymers; fatty ester modified compounds of phosphate, sorbitan, glycerol, poly(ethylene glycol), sulfosuccinic acid, sulfonic acid, alkyl amine; poly(oxyalkylene) modified compounds of sorbitan esters, fatty amines, castor oil, fatty acid, fatty alcohol; quaternary alkosulfate compounds; fatty imidazolines,; and the like. In one embodiment of the present invention, the fibers in the surface treated papers are coated with the aforementioned materials thereby reducing the levels of internal sizing and enabling, for example, these fibers to accept ink compositions with minimum spreading thereof thus preventing or minimizing wicking, a major source of undesirable print edge raggedness. The desizing components can also be applied to paper fibers on a known coater from aqueous or alcohol solutions. The aforementioned treatments can be modified as indicated herein preferably to optimize the selection of these papers for use in liquid ink printing to improve print through, which modification can be accomplished by the addition of a binder polymer such as hydroxypropylmethyl cellulose, hydroxyethyl cellulose and the like.

Paper is often sized with sizing components for the purpose of retarding or preventing penetration of liquids into the structure. This is commonly done by introducing. The acid sizing chemicals, such as Mon size available from Monsanto Chemical Company or alkaline sizing chemicals such as Hercon-76 available from Hercules Company, are precipitated onto the fibers primarily for the purpose of controlling penetration of liquids into the final dry paper. This process is known as internal sizing. Surface sizing involves the application of dispersions of film-forming substances such as converted starches, gums and modified polymers to previously formed paper. Surface sizing imparts strength to the paper and thus high quality printing papers are often surface sized as well. These internally and surface sized papers, when used to print graphics or checkerboard color patterns with an ink jet printer containing predominantly water based inks, such as for example those inks selected for the Xerox Corporation 4020 TM color ink jet printer, yield images which have undesirable pronounced inter-color bleed in most instances (high edge-raggedness). The extent of inter-color bleed is reduced slightly with papers which are internally sized and no surface sizing. However, in general, these papers usually possess undesirable adequate mechanical strength, and can exhibit enhanced print through. In conventional paper with no surface sizing but with different levels of internal sizing, the intercolor bleed of the ink jet images can be lowered with decreasing sizing, while the print through continues increasing and becomes unacceptable.

One of the objectives of the present invention is to enable a rapid drying plain ink jet paper with substantially no print through and intercolor bleed values equivalent to a paper with no internal or external sizing. This objective can be attained by, for example, treating sized papers with desizing agents which penetrate into the paper, lift the sizing from the fibers and rearrange the sizing material in the bulk of the paper which assists in overcoming print through problems. The desizing agents can be applied on a known coater to substantially any commercially available paper and thereby convert it to an ink jet paper. This treatment can also be effected to an internally sized paper at the size press by incorporating the desizing agent into starch or any other similar binder material.

In a patentability search report the following United States patents were recited: U.S. Pat. No. 4,478,682, the disclosure of which is totally incorporated herein by reference, which illustrates a method for sizing paper wherein a sizing agent and a sizing accelerator, such as the reaction product of a water soluble polyaminopolyamide, including one derived from the reaction of adipic acid and diethylene triamine, an epihalohydrin, such as epichlorohydrin, bis(hexamethylene)triamine, or polyethylene polyamines is selected; U.S. Pat. No. 4,198,269 which discloses quaternary ammonium salts of epihalohydrin polymers as fiber treating materials, examples of polymers including water soluble polymers with a predominantly polyalkyleneoxy backbone containing ammonium salt groups; U.S. Pat. No. 4,279,794 directed to a sizing composition comprised of a sizing component and an accelerator of a poly(diallylamine)epihalohydrin resin; also note the disclosure of polyaminopolyamide derived from adipic acid and diethylene triamine at column 11, lines 62 to 64; and U.S. Pat. No. 3,520,774 relating to an epihalohydrin-polyethylene amine additive for paper.

There are disclosed in U.S. Pat. No. 4,022,634 papers with internal sizing compositions comprising an aqueous mixture of ammonia, an ammonium salt, and a rosin that is modified with from about 5 to 50 percent based on the weight of the rosin of an organic acidic compound selected from the group consisting of an $\alpha$, $\beta$-unsaturated organic acid, an anhydride thereof, and mixtures thereof. In one embodiment, the ammonia and ammonium salt are produced by the reaction product of a urea and an acid selected from the group consisting of sulfamic acid, phosphoric acid, oxalic acid, methanesulfonic acid, trichloroacetic acid, nitric acid, sulfuric acid, hydrochloric acid, stearic acid, and acetic acid.

In U.S. Pat. No. 4,152,312 there are described anionic sizes for paper or a paper-like material. Substantially equimolecular copolymers of maleic acid anhydride and diisobutylene are esterified to form the corresponding semi-esters. From 10 to 100 mol percent of the anhydride groups are reacted with an aliphatic or cycloaliphatic alcohol, and at least 50 mol percent of the formed carboxylic groups are neutralized with alkali, ammonia or aliphatic amines according to the teachings of this patent in an embodiment thereof.

Further, there is disclosed in U.S. Pat. No. 4,335,184 a recording paper with improved image quality, comprising a base paper, the pH of its cold water extract being 5.0 to 10.0, and disposed thereon a coating layer containing a saponified-type petroleum resin sizing agent.

There is disclosed in U.S. Pat. No. 4,481,244 a material for writing or printing, which comprises a substrate and a coating layer formed thereon of a material containing a polymer having both hydrophilic segments and hydrophobic segments.

Also, there is illustrated in U.S. Pat. No. 4,657,946 cationically charged water soluble vinyl addition polymers and condensation polymers which provide improved emulsification of alkanyl succinic anhydride sizing agents. Sized paper products prepared from alkanyl succinic anhydride emulsions obtained with the polymers disclosed have superior ink holdout according to the teachings of this patent.

Disclosed in the U.S. Pat. No. 4,740,420 is a recording medium for ink jet printing comprising a support material containing at least in the surface portion thereof a water-soluble metal salt with the ion valence of the metal thereof being 2 to 4 and a cationic organic material.

Further, there is disclosed in U.S. Pat. No. 4,784,727 a paper with sizing agent which contains from 1 to 60 parts by weight of a fixing and sizing accelerating agent and from 0 to 80 parts by weight of conventional auxiliaries per 10 parts by weight of hydrophobic, cellulose-reactive sizing materials, the fixing and sizing accelerating agent being a polymer composed of linear or branched carbon chains to which primary, secondary or tertiary amino and/or quaternary ammonium groups are bound directly or by side chains.

Additionally, there is disclosed in U.S. Pat. No. 4,810,301 an internal size composition with a sizing agent comprising, for example, (1) 70 to 99.9 weight percent of a substituted alkyl succinic anhydride or a substituted alkanyl succinic anhydride or a mixture thereof, and (b) 0.1 to 30 weight percent of phosphates of polyoxyethylene alkyl ether esters or phosphates of polyoxyethylene alkyl aryl ether esters and a process of using this composition for the preparation of papers by dispersing the composition, adding the resulting aqueous dispersion to a pulp slurry or paper making material.

Moreover, there is disclosed in U.S. Pat. No. 4,425,405 an ink jet recording sheet comprising a paper support applied on at least one surface thereof or internally a composition which comprises an aqueous dispersion of poly(vinylpyrrolidone), vinylpyrrolidone-vinyl acetate copolymer or a mixture thereof serving as a binder or sizing agent and a white filler. The white filler can be contained in a binder weight ratio of 10:1 to 0.2:1 when the composition is applied on the surface of the paper support. When the composition is internally incorporated in the recording sheet, it can comprise 10 to 60 parts by weight of the filler and 2 to 20 parts by weight of the binder per 100 parts by weight of pulp.

Further, there is disclosed in U.S. Pat. No. 4,554,181 an ink jet recording sheet with a recording surface which includes a combination of a water soluble polyvalent metal salt and a cationic polymer, said polymer having cationic groups which are available in the recording surface for insolubilizing of an anionic dye.

The following U.S. patents are also mentioned: U.S. Pat. No. 4,701,367 relating to coatings such as styrene/butadiene/styrene triblocks for typewriter ribbon transparencies, see the Abstract of the Disclosure for example; U.S. Pat. No. 4,711,816 relating to transparent sheet materials for plain paper electrostatic imaging apparatuses, which sheets contain an image receiving layer; U.S. Pat. No. 4,783,376 relating to transparencies with a coating layer of a certain electrical resistance; and U.S. Pat. No. 4,756,961 which discloses an ink accepting coating containing particles of silica, aluminum silicate, zinc oxide, or titanium dioxide.

There are disclosed in U.S. Pat. No. 3,759,744 and U.S. Pat. No. 4,268,595 methods for the preparation of electrographic recording papers for imaging. More specifically, according to the teachings of these patents electrographic recording papers can be prepared by applying a dielectric coating on a relatively conductive sheet. Various compounds, such as salts and other compounds capable of retaining or attracting moisture in the sheet may be incorporated into the paper to enhance the conductive properties. In some recording papers the conductive layer is applied on one side of the paper and the dielectric is applied to the other side. Also, the dielectric layer can be applied over the conductive layer. Other conventional recording papers comprise an electrically conductive layer and a dielectric layer thereon on one surface of a base paper and an electrically conductive layer on the outer surface of the base paper. Materials selected as the dielectric layer include highly insulating resins such as silicone resins, epoxy resins, poly(vinyl acetate) resins, vinyl acetate resins, vinyl chloride resins and styrene-butadiene copolymers. These resins are generally dissolved in an organic solvent and coated on the base paper. It is usually necessary to provide an undercoat layer as a barrier coating on a base paper prior to the coating of a solution of an organic solvent type resin to prevent penetration of the solvent used into the paper. Examples of other electrographic papers are prepared by applying a dielectric film of plastic material such as poly(ethylene) or poly(styrene) to the paper surface by melt extrusion. Also disclosed in U.S. Pat. Nos. 3,011,918; 3,264,137; 3,348,970 and 3,110,621 are papers for electrostatic recording employing aqueous coatings both for the dielectric layer as well as the conductive layer. The materials of the conductive layer can be water soluble or dispersable vinyl benzyl quaternary ammonium compounds and the dielectric layer can be comprised of carboxylated poly(vinyl acetate) in an aqueous ammonical solution.

Also disclosed in U.S. Pat. No. 3,759,744 is an electrostatic recording paper, which paper can be prepared by applying three successive aqueous coats to a machine glazed side of a paper web. The first coating contains titanium dioxide and an electroconductive water dispersible polymer of a vinyl benzyl quaternary ammonium compound. The second coating can be comprised of oxidized starch and calcium carbonate, and the third coating may contain calcium carbonate and a carboxylated poly(vinyl acetate) in ammonical solution. The resulting web can then be dried between successive coatings and may be steam treated, see The Abstract of the Disclosure for example.

Additionally, there are disclosed in U.S. Pat. No. 3,790,435 and U.S. Pat. No. 4,318,950 synthetic papers and methods for the preparation thereof. The term synthetic paper as indicated on page 1, line 20, of U.S. Pat. No. 4,318,950 refers to a paper like laminar structure in the form of thin sheets or films of synthetic resinous material, which papers can be employed in writing or printing processes. Disclosed in U.S. Pat. No. 3,380,868 are oriented thermoplastic film laminated structures which can be selected for various imaging processes. Polymeric film structures having a matte finish and a cellular structure achieved with the addition of fillers which roughens the surface upon stretching of the films and renders them receptive to marking by crayons, pencil and ballpoint pen are disclosed in U.S. Pat. No. 3,154,461. Laminates comprising layers of oriented films of thermoplastic materials in which at least one of the outermost layers contains a suitable inert additive are disclosed in U.S. Pat. No. 3,515,626. These laminates are useful in films which may be written on by a pencil or a crayon.

Disclosed in U.S. Pat. No. 3,790,435 are synthetic papers with acceptable foldability and comprised of a nonlaminated structure of one thermoplastic resin film or a laminated structure of at least two thermoplastic resin films, see the Abstract of the Disclosure for example. Each of the films is stretched or molecularly oriented, and one or more of the films can contain a fine inorganic filter to provide paperness of the film. According to this patent, some of the films may contain certain amounts of poly(styrene) as a foldability improving agent.

Further, in U.S. Pat. No. 4,592,954, the disclosure of which is totally incorporated herein by reference, there is illustrated a transparency for ink jet printing comprised of a supporting substrate and thereover a coating of a blend of carboxymethyl cellulose, and poly(ethylene oxide). Also, in this patent there is illustrated an ink jet paper wherein the surface coating or sizing is comprised of poly(ethylene oxide).

In U.S. Pat. No. 4,865,914, the disclosure of which is totally incorporated herein by reference, there are illustrated ink jet transparencies and ink jet papers with coatings thereover which are compatible with the inks selected for marking, and wherein the coatings enable acceptable optical density images to be obtained. More specifically, in one embodiment of the aforesaid patent there are provided coatings for ink jet paper comprised of a supporting substrate, and thereover a quaternary mixture of hydroxypropyl cellulose, carboxymethyl cellulose, poly(ethylene oxide), and colloidal silica.

In U.S. Pat. No. 5,075,153, the disclosure of which is totally incorporated herein by reference, there are illustrated coated papers wherein the ink receiving layer is comprised of a blend with from about 10 to about 90 percent by weight of poly(ethylene oxide) and 90 to about 10 percent by weight of a component selected from the group consisting of (1) hydroxypropylmethyl cellulose; (2) vinylmethyl ether/maleic acid copolymer; (3) acrylamide/acrylic acid copolymer; (4) carboxymethylhydroxyethyl cellulose sodium salt; (5) hydroxyethyl cellulose; (6) water soluble ethylhydroxyethyl cellulose; (7) cellulose sulfate; (8) poly(vinyl alcohol); (9) poly(vinyl pyrrolidone); (10) hydroxybutylmethyl cellulose; (11) hydroxypropyl cellulose; (12) poly(2-acrylamido-2-methyl propane sulfonic acid); (13) methyl cellulose; (14) hydroxyethylmethyl cellulose; (15) poly(diethylene triamine-co-adipic acid); (16) poly(imidazoline) quaternized; (17) poly(ethylene imine) epichlorohydrin; (18) poly(N,N-dimethyl-3,5-dimethylene piperidinium chloride); or (19) ethoxylated poly(ethylene imine)

In U.S. Pat. No. 5,006,407, the disclosure of which is totally incorporated herein by reference, there is illustrated an ink jet paper comprised of a supporting substrate, a coating and a plasticizer.

Although the papers illustrated in the prior art are suitable for their intended purposes, there remains a need for papers with new coatings that are useful in ink jet printing processes, electrophotographic imaging and printing processes, including color processes, and that will enable the formulation of images with high optical densities. Additionally, there is a need for treated papers that can be selected for ink jet color printing processes. Another need resides in providing papers the fibers of which are coated continuously with certain copolymers as illustrated herein. Further, there is a need for papers that avoid or minimize jamming at the fuser roll, thus shortening the life thereof. Also, there is a need for static-free papers, or wherein the static charge thereon is minimized or substantially avoided. Another need resides in the provision of papers for ink jet, dot matrix, typewriters and crayon printing processes, and wherein images of high optical density, such as greater than one, are obtained in some embodiments of the present invention.

SUMMARY OF THE INVENTION

It is an object of the present invention to provide papers with many of the advantages illustrated herein.

Another object of the present invention resides in the provision of ink jet papers or xerographic papers.

Also, in another object of the present invention there are provided treated papers wherein the fibers thereof are coated with block copolymers thereover enabling, for example, images to be developed thereon which dry in less than two seconds and have acceptable optical density values, no intercolor bleeding and minimum showthrough.

Another object of the present invention resides in treated ink jet papers that permit the substantial elimination of beading caused by poor inter-drop coalescence during mixing of the primary colors to generate secondary colors such as, for example, mixtures of cyan and yellow enabling green colors.

Furthermore, in another object of the present invention there are provided electrophotographic treated sized papers that enable elimination or minimization of bleeding of colors due to intermingling or diffusion of the dry toners when different colors, for example cyan and yellow, are printed together with another color like magenta.

Another object of the present invention relates to ink jet treated papers which enable, for example, water and glycol absorption from the inks selected in a rapid manner thereby permitting such papers to be particularly useful in known ink jet printers.

In yet another object of the present invention there are provided coatings which are compatible with filled papers and sized papers, which coatings will enable the aforementioned materials to generate high optical density images with electrophotographic processes utilizing, for example, liquid toners comprised of a toner resin such as Elvax II dispersed in a solvent such as Isopar, and a charge director.

These and other objects of the present invention are accomplished by providing treated papers. More specifically, in accordance with one embodiment of the present invention there are provided papers comprised of a supporting substrate treated with a mixture of starch and desizing agent, which papers are, for example, compatible with the inks or dry toners selected for marking and wherein the papers enable acceptable optical density images to be obtained, especially in ink jet color printing processes. In one embodiment, there are provided papers treated with a mixture of starch and a desizing agent such as block copolymer of poly(ethylene oxide)-b-poly(dimethyl siloxane)-b-poly(ethylene oxide) triblock copolymer wherein the fibers thereof are coated with the block copolymers thereby, for example, reducing, avoiding, or minimizing the level of internal sizing and rendering the paper more suitable for ink jet printing.

Embodiments of the present invention include a paper comprised of a sized supporting substrate such as a Diazo paper treated with desizing agents, that is a polymeric or nonpolymeric material which will remove the sizing compositions deposited on the fibers of cellulose during the paper making process thereby reducing the sizing levels in paper, which desizing agents are comprised of (1) hydrophilic poly(dimethyl siloxanes) such as water soluble carbinol terminated poly(-dimethyl siloxane) with weight average molecular weight of, for example, from about 1,000 to about 5,000, water soluble poly(dimethyl siloxane) quaternized or poly quaternary poly(dimethyl siloxane) with a dimethyl siloxane content of from about 15 to 80 percent by weight with weight average molecular weight of, for example, from about 1,000 to 100,000; (2) poly(dimethyl siloxane)-b-poly(alkylene oxide) and poly(dimethyl siloxane)-b-poly(methylsiloxane alkylene oxide) water soluble block copolymers with a weight average molecular weight of, for example, from about 1,000 to about 5,000 and dimethyl siloxane content of from about 15 to about 80 percent by weight, where alkylene contains from 1 to about 20 carbon atoms such as ethylene, propylene and ethylenepropylene; (3) methanol and water soluble poly(propylene oxide)poly(ethylene oxide) block copolymers with a propylene oxide content of about 25 to about 99 percent and a weight average molecular weight of from about 500 to 100,000; (4) alcohol soluble, such as methanol or ethanol, and the like, poly(propylene glycol) with a weight average molecular weight of between about 400 to about 5,000, and alcohol soluble poly(propylene glycol dimethacrylate) with weight average molecular weight of between about 400 to about 5,000; (5) alcohol soluble fatty esters of phosphate, glycerol, sorbitan, mono and difatty acids, sulfonic acid, and sulfosuccinic acid; (6) alcohol soluble alkanolamides, alkanolamide ethoxylates and amine ethoxylates; (7) water soluble nonpolymeric quaternary ammonium ethosulfate; (8) fatty imidazoline quaternized water and alcohol soluble and nonquaternized alcohol soluble fatty imidazoline; and (9) alcohol and water soluble fatty alcohol modified poly(oxyalkylenes) and mixtures thereof, which sizing agents can be dispersed in a resin binder or mixtures of binders and a filler or fillers. When these desizing agents are applied to paper, they are generally present in effective amounts of from about 1 to about 20 percent by weight in water or alcohol, and preferably from about 1 to about 10 percent by weight in water. Primarily because of these low cost and nontoxic properties, desizing agents which are soluble in water are preferred.

In another embodiment of the present invention there is provided a paper comprised of a supporting substrate treated with desizing agents selected from the group consisting of (1) hydrophilic poly(dimethyl siloxanes); (2) poly(alkylene glycol), the derivatives thereof; (3) poly(propylene oxide)-poly(ethylene oxide) copolymers; (4) fatty ester modified compounds of phosphate, sorbitan, glycerol, poly(ethylene glycol), sulfosuccinic acid, sulfonic acid, or alkyl amine; (5) poly(oxyalkylene) modified compounds of sorbitan esters, fatty amines, alkanol amides, castor oil, fatty acid, orfatty alcohol; (6) quaternary alkosulfate compounds; and (7) fatty imidazolines and mixtures thereof; a paper comprised of a supporting substrate with a coating comprised of a desizing component dispersed or admixed with a binder resinous polymer; or the aforementioned papers wherein the desizing agent is present in a resin, preferably hydrophic, polymer binder.

The binder polymers when used in combination with the desizing agents are, for example, selected from the group consisting of (1) starch; (2) cationic starch; (3) gelatin; (4) hydroxyalkylmethyl cellulose where alkyl is from 1 to about 25 carbon atoms such as methyl, ethyl, propyl, butyl, pentyl, hexyl, heptyl, octyl, and the like; (5) sodium carboxymethyl cellulose; (6) sodium carboxymethylhydroxyethyl cellulose; (7) hydroxyethyl cellulose; (8) hydroxypropyl cellulose; (9) alkylhydroxyethyl cellulose where alkyl is from 1 to about 25 carbon atoms such as methyl, ethyl, propyl, butyl, and the like; (10) methyl cellulose; (11) poly(acrylamide); (12) an acrylamide-acrylic acid copolymer; (13) poly(vinyl alcohol); (14) poly(vinyl pyrrolidone); (15) poly(ethylene imine) epichlorohydrin; (16) poly(2-acrylamido-2-methyl propane sulfonic acid); (17) poly(ethylene oxide); (18) cellulose sulfate; (19) quaternary ammonium copolymers; (20) hydroxybutylmethyl cellulose; (21) vinyl methyl ether/maleic acid copolymer; (22) poly(imidazoline) quaternized; (23) hydroxyethyl methyl cellulose; (24) cationic celluloses; (25) blends or mixtures thereof with starches and celluloses being particularly preferred primarily because of their availability and applicability to paper; and the like. Mixtures or blends include the binder components in effective amounts as indicated herein including, for example, from about 5 to about 90 weight percent of one material, and about 90 to about 5 weight percent of a second material. Generally, the ratio of binder to desizing agent depends on the capacity of the desizing agent to desize paper but commonly this ratio varies from about 1 to about 10 in size press and from about 1 to about 20 in coating applications. Also, more than two components can also be selected, thus, for example, up to five components may be included in the blends providing some of the objectives of the present invention are achievable with each of the components being present in an effective amount whereby the total amount of all components is equal to about 100 percent.

The ink or toner receiving surface where the developed image is contained in an embodiment of the present invention may include brightener filler components in various effective amounts such as, for example, from about 1 to about 60 percent by weight. Examples of fillers include colloidal silicas (available, for example, as Syloid 74 from Grace Company) preferably present, for example, in one embodiment in an amount of 20 weight percent; titanium dioxide (available as Rutile or Anatase from NL Chem Canada Inc.); hydrated alumina (Hydrad TMC-HBF, Hydrad TM-HBC, J. M. Huber Corporation); barium sulfate (K. C. Blanc Fix HD80, available from Kali Chemie Corporation, and calcium carbonate (Microwhite Sylacauga Calcium Products); high brightness clays (Engelhard Paper Clays); Dow plastic pigment (722, 788 Dow Chemicals); calcium silicate (J. M. Huber Corporation); insoluble cellulosic materials (Scientific Polymer Products); and the like. The primary purpose of the brightener filler is to enhance color mixing and assist in improving print-through in an embodiment of the present invention.

In an embodiment of the present invention, the substrate is comprised of sized blends of hardwood kraft and softwood kraft fibers which blends contain from about 10 percent to 90 percent by weight of soft wood and from about 90 to about 10 percent by weight of hardwood. Examples of hardwood include Seagull W dry bleached hardwood kraft preferably present, for example, in one embodiment in an amount of 70 percent by weight. Examples of softwood include La Tuque dry bleached softwood kraft present, for example, in one embodiment in an amount of 30 percent by weight. These sized substrates may also contain fillers and pigments in effective amounts of from about 1 to about 60 percent by weight such as clay (available from Georgia Kaolin Company, Astro-fil 90 clay, Engelhard Ansilex clay), titanium dioxide (available from Tioxide Company-Anatase grade AHR), calcium silicate CH-427-97-8, XP-974 (J. M. Huber Corporation), and the like. Also, the sized substrates may contain various effective amounts of sizing chemicals (for example from about 0.25 percent to about 25 percent by weight of pulp) such as Mon size (available from Monsanto Company), Hercon-76 (available from Hercules Company), Alum (available from Allied Chemicals as Iron free alum)m, and retention aid (available from Allied Colloids as Percol 292). The sizing values of papers, including the commercial papers that can be selected for the present invention in an embodiment thereof, vary between about 0.4 second to about 4,685 seconds, however, papers in the sizing range of 50 seconds to 300 seconds are preferred, primarily to decrease costs. The porosity values of the substrates which are preferably porous varies from about 100 to about 1,260 mil/minute and preferably from about 100 to about 600 mil/minute to permit, for example, the use of these papers for various printing technologies such as thermal transfer, liquid toner development, xerography, ink jet processes, and the like.

Illustrative examples of commercially available, internally and externally (surface) sized substrates that may be selected for the present invention and are treated with a desizing agent dispersed in an optional binder with a thickness of, for example, from about 50 microns to about 200 microns and preferably of a thickness of from about 100 microns to about 125 microns that may be selected for the aforementioned papers include Diazo papers, offset papers such as Great Lakes offset, recycled papers such as Conservatree, office papers such as Automimeo, Eddy liquid toner paper and copy papers from companies such as Nekoosa, Champion, Wiggins Teape, Kymmene, Modo, Domtar, Veitsiluoto and Sanyo with Xerox 4024 TM papers and sized calcium silicate-clay filled papers being particularly preferred in view of their availability, reliability, and low print through.

Specific examples of desizing agents that can be selected for the treatment or coating on a single side, or both sides thereof of papers include (1) hydrophilic poly(dimethyl siloxanes) such as (a) Poly(dimethyl siloxane) monocarbinol terminated (PS558, Petrarch Systems Inc.) and dicarbinol terminated (PS555, PS556, Petrarch Systems Inc.); (b) poly(dimethyl siloxane)-b-poly(methyl siloxane alkylene oxide) copolymers (PS 073, PS 072, PS 071, Petrarch Systems Inc.), Alkasil HEP 182-280, Alkasil HEP 148-330, Alkaril Chemicals, non-hydrolyzable copolymers containing S1-C linkages; (c) poly(dimethyl siloxane)-b-poly(propylene oxide)-b-poly(ethylene oxide) copolymers (Alkasil NEP 73-70, Alkaril Chemicals), hydrolyzable copolymer containing S1-O-C linkages; (d) poly quaternary poly(dimethyl siloxane) copolymers (which can be obtained by the addition reaction of $\alpha$, $\omega$- hydrogen polysiloxane with epoxides containing olefinic bonds and then reacting the product with a diamine); (2) poly(alkylene glycol) and its derivatives (a) poly(propylene glycol) (Alkapol PPG-425, Alkapol PPG-4000, Alkaril Chemicals); (b) poly(propylene glycol dimethacrylate), poly(ethylene glycol diacrylate), poly(ethylene glycol dimethacrylate), poly(ethylene glycol monomethyl ether), poly(ethylene glycol dimethyl ether), poly(ethylene glycol diglycidyl ether) (all from Polysciences); (c) poly(1,4-oxybutylene glycol) (Scientific Polymer Products); (3) copolymers of liophilic poly(propylene oxide) with hydrophilic poly(ethylene oxide); (a) methanol soluble-Tetronic 150R1, Pluronic L-101, Tetronic 902, Tetronic 25R2 (BASF Corporation), Alkatronic EGE-1 (Alkaril Chemicals); (b) water soluble-Tetronic 908, 50R8, 25R8, 904, 90R4, Pluronic F-77 all from BASF Corporation, and Alkatronic EGE 25-2 and PGP 33-8 from Alkaril Chemicals; (4) fatty ester modifications of (a) phosphates (Alkaphos B6-56A, Alkaril Chemicals); (b) sorbitan (Alkamuls STO [sorbitan trioleate], Alkamuls SML [sorbitan mono laurate], Alkamuls SMO [sorbitan monooleate], Alkaril Chemicals); (c) glycerols (Alkamuls GMO-45LG [glyceryl mono oleate], Alkamuls GDO [glyceryl dioleate], Alkamuls GTO [glyceryl trioleate]); (d) poly(ethylene glycols) (Alkamuls 600 DO [di oleate], Alkamuls 400-ML [mono laurate], Alkamuls 600 MO [mono oleate], Alkamuls 600 DL [dilaurate], Alkamuls 600 DT [ditallow], Alkaril Chemicals); (e) sulfosuccinic acid (Alkasurf SS-O-75 [sodium dioctyl sulfosuccinate], Alkasurf SS-DA4-HE [ethoxylated alcohol sulfosuccinate], Alkasurf SS-L7DE [sodium sulfosuccinate ester of lauric diethanol amide], Alkasurf SS-L-HE [sodium lauryl sulfosuccinate], Alkaril Chemicals); (f) sulfonic acid (Alkasurf CA, [calcium dodecyl benzene sulfonate], Alkasurf IPAM [isopropylamine dodecyl benzene sulfonate], Alkaril Chemicals); (g) alkyl amines (Alkamide SDO [soya diethanol amide], Alkamide CDE [coco diethanol amide], Alkamide CME [coco monoethanol amide], Alkamide L9DE [lauric diethanol amide], Alkamide L7Me [lauric monoethanol amide], Alkamide L1PA [lauric monoisopropylamide], Alkaril Chemicals); (5) poly(oxyalkylene) modifcations of (a) sorbitan esters (Alkamuls PSML-4 [poly(oxyethylene) sorbitan monolaurate], Alkamuls PSMO-20 [poly(oxyethylene) sorbitan monooleate], Alkamuls PSTO-20 [poly(oxyethylene) sorbitan trioleate], Alkaril Chemicals); (b) fatty amines (Alkaminox T-2,T-5 [tallow amine ethoxylate], Alkaminox SO-5 [soya amine ethoxylate], Alkaril Chemicals), (Icomeen T-2, Icomeen T-15, ICI Chemicals); (c) castor oil (Alkasurf CO-10 [caster oil ethoxylates], Alkaril Chemicals); (d) alkanol amide (Alkamide C-2, C-5 [coconut oil alkanolamide ethoxylates], Alkaril Chemicals); (e) fatty acid (Alkasurf 075-9, Alkasurf 0-10 [oleic acid ethoxylates], Alkasurf L-14 [lauric acid ethoxylate], Alkasurf P-7 [palmitic acid ethoxylate]); (f) fatty alcohol (Alkasurf LAN-1, LAN-3 Alkasurf TDA-6, Alkasurf SA-2, [linear alcohol ethoxylates], Alkasurf NP-1, NP-11 [nonyl phenol ethoxylates], Alkasurf OP-1, OP-12 [octyl phenol ethoxylates], Alkasurf LAEF-15, Alkasurf LAEP-25, Alkasurf LAEP-65 [linear alcohol alkoxylates]); (6)

quaternary compounds (a) nonpolymeric quaternary ammonium ethosulfate (Finquat CT, Cordex AT-172, Finetex Corporation); (b) quaternary dialkyl dimethyl methosulfate (Alkaquat DHTS [hydrogenated tallow]); (c) alkoxylated difatty methosulfate quaternary (Alkasurf DAET ]tallow derivative]); (d) fatty imidazoline methosulfate quaternary (Alkaquat T [tallow derivatives]. Alkaril Chemicals); (7) fatty imidazolines and their derivatives (a) Alkazine-O [oleic derivative]; (b) Alkazine TO [tail oil derivatives]; (c) Alkateric 2CIB (dicarboxylic cocoimidazoline sodium salt), Alkaril Chemicals; (d) Arzoline-4;, (e) Arzoline-215, Baker Chemicals; and the like.

Specific examples of binder polymers within which the desizing agent can be dispersed or admixed, preferably hydrophilic film forming components, include (1) starch (Starch SLS-280, St. Lawrence Starch); (2) cationic starch (Cato-72, National Starch); (3) gelatin (calfskin gelatin, Polymer Sciences); (4) hydroxypropylmethyl cellulose (Methocel K35LV, available from Dow Chemical Company); (5) sodium carboxymethyl cellulose (CMC Type 7HOF, 7H3SX, Hercules Chemical Company); (6) hydroxyethyl cellulose (Natrosol 250LR, Hercules Chemical Company); (7) sodium carboxymethylhydroxyethyl cellulose (CMHEC 43H, 37L, Hercules Chemical Company; CMHEC 43H is a high molecular weight polymer with carboxymethylcellulose (CMC)/hydroxyethyl cellulose (HEC) ratio of 4:3; CMHEC is low molecular weight polymer with CMC/HEC ratio of 3:7); (8) hydroxypropyl cellulose (Klucel Type E, Hercules); (9) water soluble ethylhydroxyethyl cellulose (Bermocoll, Berol Kem, AB. Sweden); (10) methyl cellulose (Methocel AM4, Dow Chemical Company); (11) poly(acrylamide) (Scientific Polymer Products); (12) acrylamide-acrylic acid copolymer (Scientific Polymer Products); (13) poly(vinyl alcohol) (Elvanol, DuPont Company); (14) poly(vinyl pyrrolidone) (GAF Corporation); (15) poly(ethylene imine) epichlorohydrin (Scientific Polymer Products); (16) poly(2-acrylamido-2-methyl propane sulfonic acid) (Scientific Polymer Products); (17) poly(ethylene oxide) (Poly OX WSRN-3000, Union Carbide); (18) cellulose sulfate (Scientific Polymer Products); (19) quaternary ammonium copolymers (Mirapol WT, Mirapol AD-1, Mirapol AZ-1, Mirapol A-15, Mirapol-9, Merquat-100, Merquat-550, Miranol Incorporated); (20) hydroxy butylmethyl cellulose (HBMC, Dow Chemical Company); (21) vinylmethylether/maleic acid copolymer (Gantrez S-95, GAF Corporation); (22) poly(imidazoline) quaternized (Scientific Polymer Products); (23) hydroxyethylmethyl cellulose (HEM, British Celanese Ltd., Tylose MH, MHK, Kalle A. G.); (24) cationic hydroxyethyl cellulose (Polymer JR-125, Poly quaternium-10, Amerchol; cationic Cellosize, Union Carbide) and mixtures thereof, which mixtures include, for example, various effective amounts of from 1 to about 5 components in any embodiment of the present invention with the amount of components totaling 100 percent. Thus, for example, a first component can be present in an amount of from about 5 to about 90 weight percent and a second component can be present in an amount of from about 90 to about 5 weight percent.

The ink receiving surfaces can contain desizing compositions in various thicknesses as indicated herein depending, for example, upon the coatings selected and the components utilized; however, generally the total thickness of the treatment layer is from about 0.1 micron to about 25 microns and preferably from about 0.5 micron to 10 microns. The coating of, for example, desizing agent in binder can be applied to paper by a number of known techniques including size press treatment, dip coating, reverse roll coating, extrusion coating, and the like. The surface treatment of the papers can, for example, be accomplished on a KRK size press by dip coating and by solvent extrusion on a Faustel Coater. The KRK size press is a lab size press that simulates a commercial size press. This size press is normally sheet fed as contrasted to a commercial size press wherein a continuous web is selected. On the KRK size press in an embodiment, the sheet of paper is taped by one end to the carrier mechanism plate. The speed of the test and the roll pressures are set, and the sizing solution is poured into the solution tank. A 4 liter stainless steel beaker, for example, is situated underneath for retaining the solution overflow. The sizing solution is cycled once through the system (without moving the paper sheet) to wet the surface of the rolls and then returned to the feed tank where it is cycled the second time. While the rolls are being "wetted", the sheet is fed through the sizing rolls by pressing the carrier mechanism start button. The sized paper is then removed from the carrier mechanism plate and is placed on a 12 inch by 40 inch sheet of 750 micron thick Teflon for support and is dried on the Dynamic Former drying drum and is held under restraint to prevent shrinkage. The drying temperature is approximately 105° C. This method of sizing treats both sides of the paper simultaneously.

In dip coating, a web of the material to be coated is transported below the surface of the coating of, for example, desizing agent in binder material by a single roll in such a manner that the exposed site is saturated, followed by the removal of any excess coating by the squeeze rolls and dried at 100° C. in an air dryer.

The method of surface treating paper using a coater results in a continuous sheet of paper with the sizing material applied first to one side and then to the second side of the paper selected. With a known slot extrusion process, there is selected a flat die with the die lips in close proximity to the web of paper to be coated, resulting in a continuous film of the solution evenly distributed across the sheet, and thereafter dried in an air dryer at 100° C.

In one specific process embodiment, the papers of the present invention can be prepared by providing a porous, internally acidic sized, substrate such as diazo papers (in roll form) in a thickness of from about 100 to about 125 microns and applying to both sides of the paper by the known dip coating process on a Faustel coater, in a thickness of 0.1 to 5 microns, a desizing agent such as Cordex AT-172, which agent is present in a concentration of 2 percent by weight in water. Thereafter, the paper with the coating is air dried at 100° C. and the resulting paper can be utilized in an ink jet printer, and the like as indicated herein.

In another specific process embodiment, the papers of the present invention are prepared by providing a substrate such as Xerox 4024 TM (internally acidic sized but without any surface sizing) obtained (in roll form) in a thickness of about 108 microns and applying by coating extrusion to one side a ternary blend of poly(ethylene oxide)-b-poly (dimethyl siloxane)-b-poly(ethylene oxide), 2 percent by weight, poly(imidazoline) quaternized, 1 percent by weight, hydroxypropylmethyl cellulose, 2 percent by weight, which blend was present in a concentration of 1 percent by weight in water. Thereafter, the coating can be oven dried at 100° C. and the paper can be utilized in a 4020 TM color ink jet printer to obtain images with optical density values of 1.05 (black), 1.02 (magenta) 0.92 (cyan), 0.75 (yellow) with edge raggedness values of 0.30 (between black and yellow), 0.50 (between cyan and yellow), 0.19 (between magenta and yellow), and 0.45 (between magenta and cyan). Other papers of the present invention can be prepared in a similar or equivalent manner and wherein different components are selected, for example, or other processes are utilized.

In other specific process embodiments, the papers of the present invention are prepared by providing a substrate such as Xerox 4024 TM acidic sized, porous paper of 108 microns in thickness and applying on this paper a mixture of cationic starch, 10 percent by weight, poly-(ethylene oxide)-b-poly(dimethyl siloxane)-b-poly(ethylene oxide) triblock copolymer, 2 percent by weight, poly(imidazoline) quaternized, 1 percent by weight, from a 5 percent by weight solution in water on a size press. The thickness of the treatment blend after drying the paper at 100° C. was measured at 1 micron. These papers were fed in a Xerox 1075 TM imaging apparatus and images with optical density values of 1.3 black were obtained with a print through value of 0.055. These aforementioned papers were also printed with a Xerox 4020 TM ink jet printer and images with optical density values of 1.01 (black), 1.02 (magenta), 0.97 (cyan), 0.80 (yellow) were obtained which had a print through value of 0.105. These images could not be handwiped or lifted off with a 3M scotch tape 60 seconds subsequent to their preparation.

In another process embodiment, the papers of the present invention are prepared by providing a porous acidic sized substrate filled with calcium silicate and clay, in a thickness of 125 microns, and applying to both sides on a size press, in a thickness of 0.2 micron, a desizing agent such as Cordex AT-172, which was present in a concentration of 2 percent by weight in water. Thereafter, the paper can be air dried at 100° C. and the resulting paper is fed (manually) into a Xerox 4020 TM color ink jet printer to obtain images of high optical density, no edge raggedness and a print through value of 0.065.

In the known formation and development of xerographic images, there is generally applied to a latent image generated on a photoconductive member a toner composition (dry or liquid) of resin particles and pigment particles. Thereafter, the image can be transferred to a suitable substrate such as natural cellulose, the treated papers of the present invention, or plastic paper and affixed thereto by, for example, heat, pressure or combination thereof.

The imaging technique in ink jet printing involves the use of one or more ink jet assemblies connected to a pressurized source of ink, which is comprised of water, glycols, and a colorant such as magenta, cyan, yellow or black dyes. Each individual ink jet includes a very small orifice usually of a diameter of 0.0024 inch, which is energized by magneto restrictive piezoelectric means for the purpose of emitting a continuous stream of uniform droplets of ink at a rate of 33 to 75 kilohertz. This stream of droplets is desirably directed onto the surface of a moving web of, for example, the treated paper of the present invention, which stream is controlled to permit the formation of printed characters in response to video signals derived from an electronic character generator and in response to an electrostatic deflection system.

In thermal transfer printing, the printer such as an Okimate-20 is equipped with a data input-interface, printhead, a three color, such as magenta, cyan and yellow, transfer ribbon, a mechanism to coordinate the combination of head, paper and ribbon motion, and a properly specified output material. The data from the input interface is fed to the thermal head which makes contact with the back of the ribbon substrate and melts the inks. The melted inks are then transferred to the treated papers of the present invention.

In dot matrix printing, the printer such as a Roland PR-1012 is connected to an IBM-PC computer loaded with a screen/printer software specially supplied for the printer. Any graphic images produced by the appropriate software on the screen can be printed by using the print screen key on the computer keyboard. The ink ribbons used in dot matrix printers are generally comprised of Mylar coated with blends of carbon black with reflex blue pigment dispersed in an oil, such as rape seed oil, and a surfactant, such as lecithin. Other correctable ribbons, which are also used in typewriter printing, can be selected and are usually comprised of Mylar coated with blends of soluble nylon, carbon black and mineral oil.

The drying time of images obtained with the treated papers of the present application is the time for zero image-offset and can be measured as follows: a line comprised of different color sequences is drawn on the ink jet paper using the droplets of inks from the inkjet heads moving from left to right and back. Thereafter, this image is purposely smeared with the pinch roll of the printer by fast forwarding the paper mechanically while the pinch roll is on the top of the imaged line. This whole procedure takes about two seconds to accomplish. In the event there is no offset of the printed image on the unprinted paper, the drying time of the image is considered as less than two seconds.

The Hercules size values recited herein were measured on the Hercules sizing tester (Hercules Incorporated) as described in TAPPI STANDARD T-530 pm-83 issued by the Technical Association of the Pulp and Paper Industry. This method is closely related to the widely used ink flotation test. The TAPPI method has the advantage over the ink flotation test of detecting the end pont photometrically. The TAPPI method employs a mildly acidic aqueous dye solution as the penetrating component to permit optical detection of the liquid front as it moves through the paper sheet. The apparatus determines the time required for the reflectance of the sheet surface not in contact with the penetrant to drop to a predetermined (80 percent) percentage of its original reflectance.

The porosity values recited herein were measured with a Parker Print-Surf porosimeter which records the volume of air/minutes flowing through a sheet of paper. The edge raggedness values recited in the present application were measured using an Olympus microscope equipped with a camera capable of enlarging the recorded ink jet images. The edge raggedness value is the distance in millimeters for the intercolor bleed on a checkerboard pattern.

The optical density measurements and the print through values recited herein were obtained on a Pacific Spectrograph Color System. The system consists of two major components, an optical sensor and a data terminal. The optical sensor employs a 6 inch integrating sphere to provide diffuse illumination and 2 degrees viewing. This sensor can be used to measure both transmission and reflectance samples. When reflectance samples are measured, a specular component may be included. A high resolution, full dispersion, grating monochromator was used to scan the spectrum from 380 to 720 nanometers (nm). The data terminal features a 12 inch CRT display, numerical keyboard for selection of operating parameters, and the entry of tristimulus values; and an alphanumeric keyboard for entry of product standard information. The print through value as characterized by the printing industry is Log base 10 (reflectance of a single sheet of unprinted paper against a black background/reflectance of the back side of a black printed area against a black background) measured at a wavelength of 560 nanometers.

The following examples are being supplied to further define specific embodiments of the present invention, it being noted that these examples are intended to illustrate and not limit the scope of the present invention. Parts and percentages are by weight unless otherwise indicated.

EXAMPLE I

There were prepared 20 (8.5×11.0 inch) sheets, 112 microns in thickness, (Set-A) of a laboratory plain paper with a Hercules internal sizing value of 0.4 second, a porosity of 220 millimeters/minute on the Dynamic Former lab paper machine (manufactured by Allimand France), using a filtered fiber pad weighing 400 grams comprised of 70 percent by weight Seagull W dry bleached hardwood kraft and 30 percent by weight La Tuque dry bleached softwood, kraft beaten in the valley beater for 27 minutes. Pulp material was added to a stainless steel storage tank and the percent solids was adjusted to 0.4 percent oven dry with deionized water. The pH of the mixture was adjusted to 5.3. During the paper making process, the following operating conditions were used: wire speed—935 meters/minute, jet speed—935 meters/minute, jet to wire ratio—1.0, stock flow—1.5 liters/minute, stock pressure—2.7 bars, number of passes—105, sheet basis weight—75.0 grams/square meter, forming wire screen type—77×56 mesh plastic wire screen from Johnson Wire Company, nozzle type—Model 2504—SS, and nozzle settings—angle centered—spacing 6.0 centimeters.

The Dynamic Former was loaded with the selected forming wire screen and the main drive motor was turned on. When the forming wire reached its required speed, water was added to the Former drum to allow the water wall to become level with the retaining bars. The 400 gram pulp load (furnish) was then pumped from the holding tank to the spray nozzle, and the spray nozzle drive was started to evenly spray the furnish on the rotating wire screen. When sufficient furnish had been sprayed to form a sheet of paper, the nozzle drive motor and the pump motor were deactivated while the main drive continued to run. The excess water was then slowly removed by movement of a scoop, which caused the waterwall to drain, leaving a thin pad of pulp fiber furnish evenly distributed on the plastic wire screen. The main drive motor was then deactivated and the endless belt of fiber was carefully cut and lifted out of the Former drum while the belt was still on the plastic wire screen. The wet paper sheet (at approximately 20 percent solid) was then placed on a wool felt blanket and the plastic wire screen was removed. A sheet of 750 microns thick Teflon was placed on top of the wet paper sheet and the sandwich pad was then pressed through the Dynamic Former press section to increase the solid content to 45 percent level. This was accomplished by passing the sandwich pad between the press rolls once at a nip pressure of 4.0 bar and twice at a nip pressure of 6.0 bar. The sheet of paper along with the Teflon backing sheet was lifted off the felt wool blanket and placed on the drying drum with Teflon in contact with the dryer surface. The dryer felt was then lowered over the paper sheet and was clamped in position to restrain the sheet and prevent shrinkage during the drying process at 105° C.

These laboratory paper sheets (Set-A) with 0.4 second internal sizing, but no surface sizing, were fed individually into a Xerox Corporation 4020 TM color ink jet printer having incorporated therein four separate developer inks comprised of water, 92 percent by weight, ethylene glycol, 5 percent by weight, and a magenta, cyan, yellow and black colorant, respectively, 3 percent by weight, and there were obtained images with average optical densities of 1.04 (black), 1.03 (magenta), 0.99 (cyan) and 0.81 (yellow) with average intercolor bleed (edge raggedness) values of 0.25 millimeters (between black and yellow), 0.50 millimeter (between cyan and yellow), 0.15 millimeter (between magenta and yellow) and 0.55 millimeter (between magenta and cyan). The print through value of the black color was calculated at 0.281.

A 108 micron thick Xerox 4024 base paper with no surface sizing but an internal Hercules sizing value of 68 seconds printed under similar conditions with a Xerox 4020 TM printer had a print through value of black (0.086) for the optical density of images 1.07 (black), 1.04 (magenta), 0.93 (cyan) and 0.84 (yellow). The intercolor bleed values, however, were higher at 2.0 millimeters (between black and yellow), 0.95 millimeter (between cyan and yellow), 0.40 millimeter (between magenta and yellow), andd 0.85 millimeter (between magenta and cyan). This Xerox 4024 TM base paper was then treated on a Faustel coater with a 2 percent aqueous solution of a diblock copolymer (20 milligrams (mg) per sheet, 0.5 percent by weight of paper) comprised of poly(dimethyl siloxane)-b-poly(methyl siloxane ethylene oxide) block copolymer (PS 073) and dried in the dryer oven at 100° C. The Hercules internal sizing value of 68 seconds (before treatment) decreased to 0.4 second (after treatment) indicating that the paper was desized. The resulting 113.5 microns thick paper was then fed into a Xerox 4020 TM color ink et printer and images were obtained with optical density values of 1.0 (black), 0.97 (magenta), 0.92 (cyan) and 0.74 (yellow). The drying time for images printed on the aforementioned treated papers was less than 2 seconds as evidenced by the absence of ink offsetting or image smearing on the platen pinch roll. The print through value for black color was calculated at 0.156, an increase from 0.086, but lower than 0.281 as was the situation for the lab prepared Set-A papers with 0.4 second internal sizing and no surface sizing. The intercolor bleed values for the above prepared treated papers of the present invention were 0.30 (between black and yellow), 0.50 (between cyan and yellow), 0.19 (between magenta and yellow) and 0.45 (between magenta and cyan) which are similar to those obtained with untreated laboratory prepared 20 paper sheets Set-A with 0.4 second internal sizing, but no surface sizing. When replacing PS 073 with a mixture of PS 073 (2.0 percent by weight), poly(imidazoline) quaternized (1.0 percent by weight), hydroxypropylmethyl cellulose (2.0 percent by weight) in water as the treating solution on the coater, the print through values decreased to 0.104 without affecting the optical density and edge raggedness of images.

EXAMPLE II

There were prepared 20 sheets each (8.5×11 inches) of 10 sets of plain papers with surface pH ranging from 5.5 to 7.0 containing different levels of internal sizing (acidic Mon size available from Monsanto) but with no surface sizing on the Dynamic Former using blends of Seagull W dry bleached hardwood kraft, 70 percent by weight, and La Tuque dry bleached softwood kraft, 30 percent by weight, in combination with titanium dioxide, filler clay, alum and internal sizing. Papers were prepared from the following furnishes by the process described in Example I: [Set-B] 392 grams of pulp blend, 8 grams of titanium dioxide (Hercules sizing value 0.4 second, porosity 230 mil/minute); [Set-C] 392 grams of pulp blend, 8 grams of titanium dioxide, 1 gram of sizing, 1 gram of alum and 0.3 gram of retention aid (Hercules sizing value of 20 seconds, porosity 330 mil/minute); [Set-D] 392 grams of pulp blend, 8 grams of titanium dioxide, 2 grams of sizing, 2 grams of alum and 0.3 gram of retention aid (Hercules sizing value 355 seconds, porosity 275 mil/minute); [Set-E] 392 grams of pulp blend, 8 grams of titanium dioxide, 4 grams of sizing, 4 grams of alum and 0.3 gram of retention aid (Hercules sizing value 455 seconds, porosity 240 mil/minute); [Set-F] 372 grams of pulp blend, 8 grams of titanium dioxide, 20 grams of clay (Hercules sizing value 0.4 second, porosity 220 mil/minute); [Set-G] 372 grams of pulp blend, 8 grams of titanium dioxide, 20 grams of clay, 2 grams of sizing, 2 grams of alum and 0.3 gram of retention aid (Hercules sizing value 90 seconds, porosity 240 mil/minute); [Set-H] 372 grams of pulp blend, 8 grams of titanium dioxide, 20 grams of clay, 4 grams of sizing, 4 grams of alum and 0.3 gram of retention aid (Hercules sizing value of 560 seconds, porosity 260 mil/minute); [Set-I] 332 grams of pulp blend, 8 grams of titanium dioxide and 60 grams of clay (Hercules sizing value 0.4 second, porosity 180 mil/minute); [Set-J] 332 grams of pulp blend, 8 grams of titanium dioxide, 60 grams of clay, 2 grams of sizing, 2 grams of alum, 0.3 gram of retention aid (Hercules sizing value 40 seconds, porosity 220 mil/minute); and [Set-K] 332 grams of pulp blend, 8 grams of titanium dioxide, 60 grams of clay, 4 grams of sizing, 4 grams of alum, 0.3 gram of retention aid (Hercules sizing value 135 seconds, porosity 230 mil/minute). Seven sets of these papers with no surface sizing but having internal sizing values of 20, Set-C; 40, Set-J; 90, Set-G; 135, Set-K; 355, Set-D; 455, Set-E; 560, Set-H, seconds were printed in a Xerox 4020 TM color ink jet printer. The intercolor bleed values ranged between 1.0 to 3.0 (between black and yellow); 0.75 to 2.5 (between cyan and yellow); 0.3 to 1.8 (between magenta and yellow); and 0.7 to 2.7 (between magenta and cyan). These seven papers were treated in the lab by dip coating them with aqueous solutions (concentrations ranging between 0.25 gram/100 milliliters to 4.0 grams/100 milliliters, respectively) of the desizing agent poly(dimethyl siloxane)-b-poly(ethylene oxide)-b-poly(propylene oxide) block copolymer Alkasil NEP 73-70, a copolymer, and oven dried on 100° C. To achieve an internal sizing value for all seven sets of papers to a level of 0.4 second, the percent concentration of Alkasil NEP 73-70 by weight of the paper was approximately 0.5, 1.0, 2.0, 3.0, 4.0, 5.0 and 6.0, the lowest being for sizing values of 20 seconds and the highest being for the sizing value of 560 seconds. The average optical density values of images with Set-C to Set-E papers which did not contain any clay were 1.06 (black), 1.05 (magenta), 1.03 (cyan) and 0.83 (yellow). The average optical density values for Set-G, Set-H papers (5 percent clay) and Set-J, Set-K (15 percent clay) were 1.03 (black), 1.0 (magenta), 0.96 (cyan), 0.79 (yellow) and 0.95 (black), 0.93 (magenta), 0.86 (cyan), and 0.72 (yellow), respectively. The values of optical densities for treated papers at internal sizing of 0.4 second are similar to those obtained with their respective untreated blank samples such as Set-B, Set-F, Set-I having Hercules internal sizing value of 0.4 second. However, the edge raggedness (intercolor bleed) values of seven treated papers at Hercules sizing value of 0.4 second were reduced to 0.32 (between black and yellow), 0.45 (between cyan and yellow), 0.17 (between magenta and yellow), and 0.50 (between magenta and cyan). The print through values of images for untreated papers of Set-B and treated papers for Set-C, Set-D and Set-E containing no filler were calculated at 0.275, 0.205, 0.150 and 0.135, respectively. The print through values of images for untreated papers of Set-F and treated papers of Set-G and Set-H containing 5 percent clay were calculated at 0.270, 0.161 and 0.120. The print through values of images for untreated papers from Set-I and treated papers from Set-J and Set-K containing 15 percent by weight of filler clay were calculated at 0.265, 0.130 and 0.125, respectively. These results suggest that the desized but rearranged sizing composition as well as filler clay help to improve print through. The porosity values of the seven sets of treated papers increased only by about 20 percent suggesting that the aforementioned desizing of papers is the predominant factor in improving the edge raggedness of ink jet images.

EXAMPLE III

There were prepared 20 sheets each (8.5×11.0 inches) of three sets of filled papers (surface pH 9.5) containing different levels of calcium silicate (CH-427-97-8), but no internal sizing and no surface sizing, on the Dynamic Former using blends of Seagull W dry bleached hardwood kraft, 70 percent by weight, and La Tuque dry bleached softwood kraft, 30 percent by weight. Papers were prepared from the following furnishes by the procedure described in Example I: Set-L, 360 grams of pulp, 40 grams of calcium silicate (paper thickness 116 microns, porosity 325 mil/minute, Hercules internal sizing 0.3 second); Set-M, 320 grams of pulp, 80 grams of calcium silicate (paper thickness 127 microns, porosity 325 mil/minute, Hercules internal sizing 0.3 second); and Set-N, 280 grams of pulp, 120 grams of calcium silicate (paper thickness 142 microns, porosity 330 mil/minute, Hercules internal sizing 0.3 second). These three sets of papers were printed with Xerox 4020 TM color ink jet printer and images were obtained. The edge raggedness values of all three sets were recorded at 0.11 (between black and yellow), 0.22 (between cyan and yellow), 0.13 (between magenta and yellow), and 0.38 (between magenta and cyan). The average optical density of all three sets, Set-L, Set-M, Set-N were measured at 0.98, 1.02, 0.98 (black); 0.98, 0.95, 0.87 (magenta); 0.94, 0.93, 0.85 (cyan); and 0.77, 0.74, 0.67 (yellow), respectively. The print through values for Set-L, Set-M and Set-N were recorded at 0.175, 0.128, 0.095, respectively. These three sets of papers were treated with Cordex AT-172 of the present invention by affecting a dip coating process using 1 percent aqueous solutions and dried at 100° C. in an oven. These treated papers were then fed into a Xerox 4020 TM color ink jet paper and images were obtained with the following characteristics: print through values for Set-L (paper thickness 122.7 microns, porosity 360 mil/minute); Set-M (paper thickness 128.8 microns, porosity 335 mil/minute); and Set-N (paper thickness 148.1 microns, porosity 360 mil/minute) were lowered to 0.135, 0.092 and 0.064, respectively; no change in the edge raggedness values; optical densities of images were measured at 1.11, 1.02, 1.09 (black); 1.07, 1.02, 0.97 (magenta); 1.06, 0.97, 1.00 (cyan); and 0.81, 0.77, 0.78 (yellow), a slight increase in most cases. These results indicate that this desizing agent improves print through as well as the optical density of the images. Furthermore, a comparison of the print through values for untreated lower cost clay filled papers from Set-F and Set-I (0.265 and 0.250) with higher cost calcium silicate filled papers of Set-L (0.175) indicates that the latter material was superior in improving print through in this instance.

EXAMPLE IV

Commercially available internally and surface sized Diazo papers 90 micron in thickness and with an average Hercules sizing value of 1,100 seconds were treated in the laboratory using a dip coating process with aqueous solutions and methanol solutions of the following commercial desizing agents and dried at 100° C. in an oven. The Hercules sizing values for the treated papers were measured in seconds and are presented in parentheses following the identity of the material, for 1 percent by weight, 99 percent of water; aqueous solutions of Tetronic 908 (436.5), Tetronic 50R8 (414.5), Finquat CT (351), Alkatronic PGP 33-8 (250.5), Tetronic 25R8 (161), Pluronic F-77 (107.5), Icomeen T-15 (90.5), Alkateric 2C1B (54.5), Tetronic 904 (28), Tetronic 90R4 (26), PS 072 (19.5), PS 555 (10.5), Alkasurf CO-25B (9), Alkasurf LAEP65 (5), Alkasurf 0-14 (4.5), Alkasurf OP-12 (4), Alkatronic EGE 25-2 (4), Alkasil NEP73-70 (4), PS071 (4), PS556 (3), PS073 (3), Cordex AT-172 (2), Alkasurf LAEP25 (1.5), and Alkasurf LAEP-15 (0.5); for 1 percent by weight methanol solution, poly(1,4-oxybutylene) glycol (29), Alkaquat DAET (15), Alkasurf CO-10 (7), Alkaquat-T (6.5), Arzoline-215 (6), Alkazine-O (6), Alkaphos B6-56A (3.5), Alkasurf NP-1 (3.5), Pluronic 25R2 (3.5), Tetronic 902 (3), Alkamuls 600DO (2.5), Alkasurf 075-9 (2), Alkasurf SA-2 (1.5), Alkasurf LAN-3 (1), poly(propylene glycol dimethacrylate) (1), Alkaminox T-2, (1) poly(propylene glycol) (1), Icomeen T-2 (1), Alkamide CDE (1), Tetronic 150R1 (1), Alkasurf TDA-6 (1), Pluronic L101 (1), Alkamidox C-2 (1), Alkamuls SML (1), Alkamuls STO (1), Alkasurf CA (0.5), Alkasurf SS-0-75 (0.5), Alkasurf LAN-1 (0.5), Alkamuls GMO-45LG (0.5), and Alkamide SDO (0.5); for water alone no desizing agent (1,050); and for methanol alone no desizing agent (784.5).

EXAMPLE V

The following commercially available internally and surface sized papers with a wide range of Hercules sizing (expressed in seconds), and porosity (expressed in mil/minute) were selected for treatment with ASA desizing agent by repeating the procedure of Example IV. The alkaline ASA sized paper are comprised of copy paper-1 (15 seconds, 840 mil/minute), copy paper-2 (82.7 seconds, 545 mil/minute), Sanyo-L (23.3 seconds, 833 mil/minute), and AKD sized copy paper-3 (58.3 seconds, 605 mil/minute); the acid sized Diazo papers (1,050 seconds, 375 mil/minute), Great Lakes offset paper (271.3 seconds, 425 mil/minute), recycled Conservatree paper (22.4 seconds, 430 mil/minute), Automimeo office papers (85.0 seconds, 1,260 mil/minute), Eddy liquid toner paper (52.5 seconds, 70 mil/minute) copy papers from Nekoosa (150 seconds 680 mil/minute), Champion (250 seconds, 840 mil/minute), Xerox 4024 TM (no surface sizing) (68 seconds, 915 mil/minute), Wiggins Teape (67.2 seconds, 400 mil/minute), Kymmene (100 seconds, 550 mil/minute), Domtar (26 seconds, 680 mil/minute), Modo (37.7 seconds, 485 mil/minute), Veitsiluto (246.4 seconds, 840 mil/minute), ink jet papers, James River Ultra (303 seconds, 131 mil/minute), Hewlett Packard Paint-Jet (194 seconds, 353 ml/minute), and Jujo (207 seconds, 125 ml/minute) were treated with 1 percent aqueous solution of Cordex AT-172 by a dip coating process and dried at 100° C. in an oven. The Hercules sizing and porosity values of the treated papers were recorded as follows: Diazo paper (1.8 seconds, 410 mil/minute), Great Lakes offset (1.5 seconds, 460 mil/minute), Conservatree (0.3 second, 620 mil/minute), Nekoosa (0.8 second, 610 mil/minute), Champion (1.2 seconds, 660 mil/minute), Automimeo (0.7 second, 1,200 mil/minute), Eddy liquid toner paper (0.5 second, 80 mil/minute), Xerox 4024 TM (no surface sizing) (0.5 second, 945 mil/minute), Wiggins Teape (0.9 second, 460 mil/minute), Kymmene (0.6 second, 605 mil/minute), Domtar (0.3 seconds, 715 mil/minute), copy paper-1 (0.5 second, 900 mil/minute), copy paper-2 (0.5 second, 530 mil/minute), copy paper-3 (0.4 second, 660 mil/minute), Modo (0.5 second, 505 mil/minute), Veitsiluto (1.4 seconds, 850 mil/minute), Sanyo-L (0.1 second, 885 mil/minute), James River Ultra (8.2 seconds, 208 mil/minute), Hewlett Packard Paint Jet (0.3 second, 550 mil/minute), and Jujo (1.5 seconds, 125 mil/minute). These results indicate that the desizing agents of the present invention can desize a variety of papers containing alkaline and acid sizing compositions and render them suitable for ink jet printing without causing excessive changes in their porosity values which can be of importance for certain printing applications such as liquid toner printing with solvent or oil based inks.

EXAMPLE VI

There were prepared by substantially repeating the procedure of Example V 100 (8.5×11 inches) sheets (Set-O) of treated papers by affecting a size press treatment of a Xerox 4024 TM base paper (which had no surface sizing) with a mixture of cationic starch (10 percent by weight), poly(ethylene oxide)-b-poly(dimethyl siloxane)-b-poly(ethylene oxide) triblock copolymer PS 556 (2 percent by weight), poly(imidazoline) quaternized (1 percent by weight), which mixture was present in a concentration of 5 percent by weight in water. These sheets were dried at 105° C. on the drying drum of the Dynamic Former. Ten of these sheets were then fed into a Xerox 4020 TM color ink jet printer and images were obtained. The average optical density of 100 images was 1.01 (black), 1.02 (magenta), 0.97 (cyan) and 0.80 (yellow). The average edge raggedness values of 100 papers were calculated at 0.25 (between black and yellow), 0.40 (between cyan and yellow), 0.15 (between magenta and yellow), and 0.50 (between magenta and cyan) with a print through value of 0.105. These 100 images could not be handwiped or lifted off with a 3M scotch tape 60 seconds subsequent to their preparation.

EXAMPLE VII

Ten sheets of treated papers from Set-O obtained from Example VI were fed into a Xerox Corporation 1005 TM color xerographic apparatus and images were obtained with average optical density values of 1.63 (black), 1.22 (magenta), 1.72 (cyan) and 0.88 (yellow). The print through value of black was calculated at 0.060. These images could not be handwiped or lifted off with a 3M scotch tape 60 seconds subsequent to their preparation.

EXAMPLE VIII

Ten sheets of treated papers from Set-O obtained from Example VI were fed through a Xerox Corporation 1075 TM imaging apparatus and yielded images with an average optical density of 1.3 (black) with a print through value of 0.055. These images could not be handwiped or lifted off 60 seconds subsequent to their preparation.

EXAMPLE IX

Ten sheets of treated papers from Set-O obtained from Example VI were fed into a dot matrix printer, available from Roland Inc. as Roland PR-1012. The average optical density of the resulting images was 1.15 (black) with a print through value of 0.150. These images could not be handwiped or lifted off 60 seconds subsequent to their preparation.

EXAMPLE X

Ten sheets of treated papers from Set-O obtained from Example VI were fed into a Xerox Corporation Memorywriter TM (typewriter) equipped with a single strike ribbon and images of optical density 1.1 (black) were obtained. These images could not be handwiped or lifted off 60 seconds subsequent to their preparation.

EXAMPLE XI

There were prepared ten sheets of treated papers each in a thickness of 91 microns by affecting a dip coating of 87.6 microns thick internally and surface sized liquid toner papers (Hercules sizing value 52.5 seconds, porosity 70 mil/minute) in a mixture of hydroxypropyl cellulose (1 percent by weight) and Alkazine-0 (2 percent by weight), which mixture was present in a concentration of 3 percent by weight in methanol. These sheets were then dried at 100° C. in an oven. Five of these ten sheets were fed into a Xerox Corporation 4020 TM and images were obtained with average optical density values of 1.05 (black), 1.0 (magenta), 1.05 (cyan), and 0.79 (yellow). The edge raggedness values for these images were 0.40 (between black and yellow), 0.60 (between cyan and yellow), 0.25 (between magenta and yellow) and 0.60 (between magenta and cyan). The print through value for black was calculated at 0.160. In comparison, an untreated liquid toner paper when fed into Xerox Corporation 4020 TM ink jet printer had images with slightly higher optical density values at 1.18 (black), 1.18 (magenta), 1.13 (cyan), and 0.86 (yellow) but the edge raggedness of these images was much higher at 2.5 (between black and yellow), 2.0 (between cyan and yellow), 1.0 (between magenta and yellow), and 1.4 (between magenta and cyan) with a print through value for black at 0.106. The five remaining sheets were fed into an Okimate-20 (Oki Company) thermal transfer printer. The resulting images had average optical density values of 1.24 (black), 0.84 (magenta) and 1.10 (cyan). In comparison, an untreated liquid toner paper when printed with Okimate-20 yielded images with slightly higher optical density values of 1.28 (black), 0.99 (magenta) and 1.27 (cyan).

EXAMPLE XII

There were prepared 20 sheets each (8.5×11 inches) of three sets (Set-P, Set-Q, Set-R) of filled papers with a surface pH of 7.0 containing identical levels of (CH427-97-8) calcium silicate, alum, clay, titanium dioxide but different degrees of internal sizing (acidic Mon size available from Monsanto Company) and no surface sizing on the Dynamic Former using blends of Seagull W dry bleached hardwood kraft, 70 percent by weight, and La Tuque dry bleached softwood kraft, 30 percent by weight. Papers were prepared from the following furnishes using the procedure described in Example I: Set-P, Set-Q, and Set-R all contain 280 grams of pulp, 60 grams of calcium silicate, 40 grams of clay, 20 grams of titanium dioxide, 30 grams of alum, and 0.3 gram of retention aid, but differ in the amount of sizing in each case, for example, Set-P contains 12 grams of sizing (Hercules internal sizing 204 seconds, paper thickness 118 microns, porosity 245 mil/minute), Set-Q contains 18 grams of sizing (Hercules internal sizing value of 468 seconds, paper thickness 127 microns, porosity 265 mil/minute), and Set-R contains 32 grams of sizing (Hercules internal sizing 767 seconds, paper thickness 124.5 microns, porosity 265 mil/minute). Five papers from each set were individually fed into a Xerox Corporation 4020 TM ink jet printer and images were obtained with an average optical density value of 1.1 (black), 1.0 (magenta), 0.90 (cyan), and 0.75 (yellow) with edge raggedness values of 0.40 (between black and yellow), 0.55 (between cyan and yellow), 0.35 (between magenta and yellow) and 0.75 (between magenta and cyan). Five papers from each set were treated with a 1 percent by weight solution of Alkasurf LAEP15 and five other papers from each set were treated with a 50:50 blend of Alkasurf LAEP15 and hydroxyethyl cellulose 250 LR, which blend was present in a concentration of 2 percent by weight in water. These papers were dried at 100° C. in an oven. The Hercules internal sizing value of all treated papers was about 0.5 second. These papers were fed into a Xerox Corporation 4020 TM ink jet printer and images were obtained with edge raggedness values of 0.12 (between black and yellow), 0.25 (between cyan and yellow), 0.15 (between magenta and yellow) and 0.38 (between magenta and cyan). The average optical density values of the papers treated with Alkasurf LAEP15 alone were 0.90 (black), 0.85 (magenta), 0.75 (cyan), and 0.65 (yellow). Papers treated with blends of Alkasurf LAEP15 and hydroxyethyl cellulose 250LR had optical density values of 1.05 (black), 0.97 (magenta), 1.02 (cyan) and 0.76 (yellow). The print through values of treated papers from Set-P (initial Hercules internal sizing value 204 seconds), Set-Q (initial Hercules internal sizing value 468 seconds), and Set-R (initial Hercules sizing value 767 seconds) were calculated at 0.073, 0.048, and 0.053 for treatment with Alkasurf LAEP15 alone and at 0.092, 0.056, and 0.067 for treatment with a blend of Alkasurf LAEP15 and hydroxyethyl cellulose 250 LR. These results suggest that the initial high sizing composition helps improve print through even though the fibers are desized after treatment. The porosity values after treatment of three sets of papers with Alkasurf LAEP 15 alone increased by about 20 to 30 percent, but remained unchanged when treated with blends of Alkasurf LAEP15 and hydroxyethyl cellulose 250 LR.

EXAMPLE XIII

There were prepared 40 sheets (8.5×11 inches) each of two sets (Set-S, Set-T) of filled papers with surface pH of 9.0 containing identical levels of (XP 974) calcium silicate, titanium dioxide, but different degrees of internal sizing (alkaline sizing Hercon-76 available from Hercules Chemical Company) and no surface sizing on the Dynamic Former using blends of Seagull W dry bleached hardwood kraft, 70 percent by weight, and La Tuque dry bleached softwood kraft, 30 percent by weight. Papers were prepared from the following furnishes using the procedure described in Example I, Set-S and Set-T both contain 280 grams of pulp, 100 grams of calcium silicate, 20 grams of titanium dioxide, 0.3 gram of retention aid but differ in the amount of sizing in each instance, thus Set-S contains 15 grams of sizing (Hercules internal sizing value of 2,865 seconds, paper thickness of 130 microns, porosity of 450 mil/minute), and Set-T contains 30 grams of sizing (Hercules internal sizing value of 4,685 of seconds, paper thickness of 130 microns, porosity of 375 mil/minute). Two papers from each set were individually fed into a Xerox Corporation 4020 TM ink jet printer and images were obtained with an average value of 0.76 (black), 0.70 (magenta), 0.65 (cyan), and 0.60 (yellow) with edge raggedness values of 0.40 (between black and yellow), 0.55 (between cyan and yellow), 0.35 (between magenta and yellow), and 0.75 (between magenta and cyan). Two papers from each set were treated with the following desizing agents of this invention and the Hercules sizing values for treated papers were measured in seconds and are presented in brackets following the identity of the desizing agent. Treatments with 5 percent by weight solutions in methanol yield: (1) poly(propylene glycol) Alkapol PPG-4000 (0.9 second); (2) tetra functional block copolymers of propylene oxide and ethylene oxide, Tetronic 150 RI, (1.2 seconds) and Pluronic L-101 (1.2 seconds); (3) sorbitan monolaurate, Alkamuls SML (0.9 second); (4) glyceryl monooleate, Alkamuls GMO-45LG (3.9 seconds); (5) poly(ethylene glycol dioleate), Alkamuls 600 DO (0.6 second); (6) phosphate ester, B6-56A (1.5 seconds); (7) sodium dioctyl sulfosuccinate, Alkasurf SS-0-75 (0.7 second); (8) calcium dodecyl benzene sulfonate, Alkasurf CA (0.8 second); (9) cocodiethanol amide, Alkamide CDE (0.7 second); (10) amine ethoxylates, Alkaminox-T2 (3.4 seconds); (11) alkanolamide, Alkamidox C-2 (3.0 seconds); (12) linear alcohol ethoxylate, Alkasurf LAN-1 (0.9 second), nonyl phenol ethoxylate, Alkasurf, NP-1 (7.9 seconds); ethoxylates of sorbitan monolaurate, Alkamuls PSML-4 (1.5 seconds); (13) Imidazoline oleate, Alkazine-0 (1.4 seconds); (14) castor oil ethoxylates, Alkasurf CO-10 (4.6 seconds); and with 5 percent by weight solutions in water of (15) linear alcohol alkoxylate, Alkasurf LAEP-25; (16) poly(dimethyl siloxane)-b-poly(methylsiloxane alkylene oxide), Alkasil HEP 182-280 (1.5 seconds); (17) dicarbinol terminated poly(dimethyl siloxane), PS556 (0.6 second); (18) linear alcohol alkoxylate, Alkasurf LAEP-15 (0.4 second); (19) linear alcohol alkoxylate, Alkasurf LAEP-65 (1.3 seconds); and (20) quaternary ammonium ethosulfate, Cordex AT-172 (0.8 second). These papers had deposited on them approximately 300 milligrams of the desizing agent (7.5 percent by weight of the paper). These papers were fed individually into a Xerox Corporation 4020 TM color ink jet printer and images were obtained which dried in less than two seconds and had an average optical density value of 0.76 (black), 0.70 (magenta), 0.60 (cyan), and 0.55 (yellow) for the methanol soluble desizing agents and 0.87 (black), 0.80 (magenta), 0.85 (cyan), and 0.80 (yellow) for the water soluble desizing agents. The edge raggedness values of all desizing agents were in the vicinity of 0.12 (between black and yellow), 0.25 (between cyan and yellow), 0.15 (between magenta and yellow), and 0.40 (between magenta and cyan). The print through values of Set-S treated samples with initial Hercules sizing value of 2,865 seconds were slightly higher at 0.056 compared to Set-T (4,685 seconds) treated samples with print through values of 0.043. These results indicate that the desizing agents of the present invention desize fibers and yield fast drying images with improved edge raggedness. Treated papers with high initial sizing yield better print through than those with lower initial sizing in this embodiment.

EXAMPLE XIV

There were prepared 5 treated papers of a thickness of 124.5 microns and porosity 265 ml/minute from Set-R of Example XII by affecting a dip coating of these sheets into a coating solution of Alkazine-0, which coating was present in a concentration of 2 percent by weight in methanol. Subsequent to oven drying at 100° C. and monitoring the weight prior to and subsequent to coating, these sheets had present about 100 milligrams, (50 milligrams on each side, 2.5 percent by weight of the paper) 0.5 micron in thickness, of Alkazine-O (each side). These papers were calendered in a 3 Roll Lab Calender Stack (Perkins Company) to a porosity of 100 mil/minute and a thickness of 90 microns. Two of these papers were fed into an Okimate-20 (Oki Company) thermal transfer printer. The resulting images had optical density values of 1.40 (black), 1.12 (magenta) and 1.5 cyan with a print through value of 0.070. Two other papers were fed into a Xerox 4020 TM color ink jet printer and there were obtained images with optical density values of 0.96 (black), 0.91 (magenta) 0.88 (cyan), and 0.74 (yellow) with a print through value of 0.150. The edge raggedness of these images were recorded at 0.15 (between black and yellow), 0.25 (between cyan and yellow), 0.15 (between magenta and yellow) and 0.40 (between magenta and cyan).

The above results indicate that sized and filled papers when treated with the desizing materials and calendered to low porosities are useful for ink jet, andd thermal transfer printing, and the like, where low porosity papers are selected.

EXAMPLE XV

There were prepared five treated papers in a thickness of 124.5 microns, porosity 265 ml/minute from Set-R of Example XII by affecting a dip coating of these sheets into a coating blend of Cordex AT-172, 10 percent by weight, hydroxyethyl cellulose 250 LR, 40 percent by weight, ammonium quaternary compound, Mirapol-9, 20 percent by weight, and colloidal silica (Syloid 244×1,517), 30 percent by weight, which blend was present in a concentration of 3 percent by weight in water. Subsequent to oven drying at 100° C. and monitoring the weight prior to and subsequent to coating, these sheets had present on each side 2.5 grams per meter square of the coating mixture, 5 microns thick on each side of the sheet. The Hercules sizing value for this coated paper was measured to be 1.3 seconds and porosity value of 25 mil/minute. These sheets were then fed individually into a Xerox Corporation 4020 TM color ink jet printer and images were obtained with optical density values of 1.48 (black), 1.30 (magenta), 1.38 (cyan) 0.89, and (yellow) with edge raggedness values of 0.16 (between black and yellow), 0.30 (between cyan and yellow), 0.15 (between magenta and yellow), and 0.40 (between magenta and cyan), and print through value of 0.050. The print through value for commercially available Jujo silica-coated paper of 96.5 microns thickness, Hercules sizing value of 207 seconds, porosity 125 mil/minute, with optical density values of 1.45 (black), 1.33 (magenta), 1.55 (cyan), and 0.98 (yellow) when printed with a Xerox Corporation 4020 TM ink jet printer, was 0.076.

Other modifications of the present invention will occur to those skilled in the art subsequent to a review of the present application. These modifications, including equivalents thereof, are intended to be included within the scope of the present invention.

What is claimed is:

1. An ink jet water absorbing paper comprised of a supporting substrate surface treated with desizing agents comprised of (1) hydrophilic poly(dialkylsiloxanes).

2. A paper in accordance with claim 1 wherein the desizing agent is admixed with a resin binder polymer.

3. A paper in accordance with claim 1 wherein the desizing agent is dispersed in or admixed in a film forming binder with filler components.

4. A paper in accordance with claim 1 wherein the supporting substrate is treated on both surfaces thereof with the desizing agents.

5. A paper in accordance with claim 1 wherein the hydrophilic poly(dialkyl siloxanes) are comprised of (a) carbinol terminated poly(dimethyl siloxanes) selected from the group consisting of poly(ethylene oxide)-b-poly(dimethyl siloxane) diblock copolymers or poly-(ethylene oxide)-b-poly(dimethyl siloxane)-b-poly(ethylene oxide) triblock copolymers; (b) poly(dimethyl siloxane)-b-poly(ethylene oxide)-b-poly(propylene oxide) triblock copolymers; (c) poly(dimethyl siloxane)-b-(methyl siloxane alkylene oxide) diblock copolymers where alkylene is ethylene, propylene or ethylene-propylene; or (d) poly quaternary poly(dimethyl siloxane).

6. A paper in accordance with claim 2 wherein the binder polymer is comprised of (1) hydroxypropylmethyl cellulose; (2) sodiumcarboxymethyl cellulose; (3) hydroxyethyl cellulose; (4) sodium carboxymethylhydroxyethyl cellulose; (5) hydroxypropyl cellulose; (6) ethylhydroxyethyl cellulose; (7) methyl cellulose; (8) cellulose sulfate; (9) hydroxybutyl methyl cellulose; (10) hydroxyethyl methyl cellulose; or (11) cationic hydroxyethyl cellulose.

7. A paper in accordance with claim 3 wherein the filler components are comprised of clay, calcium silicate, calcium carbonate, hydrated alumina, or cellulosic materials; and wherein the pigment components are comprised of calcium silicate, titanium dioxide, barium sulfate, or mixtures thereof.

8. A paper in accordance with claim 2 wherein the desizing agent is present in an amount of about 0.25 to about 20 percent by weight of the paper.

9. A paper in accordance with claim 2 wherein the ratio of binder polymer to the desizing agent is from about 1 to about 20.

10. A paper in accordance with claim 3 wherein the ratio of filler to binder polymer is from about 0.1 to about 5.

11. A paper in accordance with claim 1 wherein the surface treatment of the papers comprises coating the paper fibers.

12. An ink jet water absorbing paper comprised of a supporting substrate with a coating of desizing components comprises of (1) hydrophilic poly(dialkyl siloxanes), which desizing agents are dispersed in or admixed with a resin binder polymer.

13. A paper in accordance with claim 12 wherein the resin binder polymer is a hydrophilic film forming component.

14. A paper in accordance with claim 12 wherein the supporting substrate contains a coating on both sides of the desizing agent and the binder polymer.

15. An ink jet water absorbing paper comprised of a supporting substrate with a coating thereover comprised of a desizing component and a hydrophilic polymer and wherein the desizing component is comprised of (1) hydrophilic poly(dimethyl siloxanes).

* * * * *